US005244452A

United States Patent [19]

Vaccaro et al.

[11] Patent Number: 5,244,452

[45] Date of Patent: Sep. 14, 1993

[54] INFANT INCUBATOR MATTRESS POSITIONING ASSEMBLY

[75] Inventors: Robert K. Vaccaro, Philadelphia; Joseph J. Lessard, Horsham, both of Pa.

[73] Assignee: Air-Shields, Inc., Hatboro, Pa.

[21] Appl. No.: 845,209

[22] Filed: Mar. 3, 1992

Related U.S. Application Data

[63] Continuation-in-part of Ser. No. 656,420, Feb. 15, 1991, abandoned.

[51] Int. Cl.[5] ..... A61G 11/00

[52] U.S. Cl. ..... 600/22; 5/603; 5/607

[58] Field of Search ..... 600/21-22; 5/613, 615, 455, 600-603, 607, 611, 612

[56] References Cited

U.S. PATENT DOCUMENTS

| | | |
|---|---|---|
| 1,986,035 | 1/1935 | Wells . |
| 3,292,902 | 12/1966 | Lynch . |
| 3,335,713 | 8/1967 | Grosholz et al. . |
| 3,392,412 | 7/1968 | Aymar . |
| 3,667,075 | 6/1972 | Ballard et al. . |
| 4,099,276 | 7/1978 | Hunt et al. . |
| 4,142,263 | 3/1979 | Pierson . |
| 4,287,620 | 9/1981 | Zur . |
| 4,525,885 | 7/1985 | Hunt et al. . |
| 4,734,945 | 4/1988 | Wright . |
| 4,873,731 | 10/1989 | Williamson . |
| 4,885,918 | 12/1989 | Vaccaro . |

FOREIGN PATENT DOCUMENTS

| | | |
|---|---|---|
| 2651588 | 12/1987 | Australia . |
| 0262771 | 8/1987 | European Pat. Off. . |
| 0291195 | 4/1988 | European Pat. Off. . |
| 8603965 | 12/1984 | PCT Int'l Appl. . |
| 8606624 | 5/1986 | PCT Int'l Appl. . |
| 0891094 | 12/1981 | U.S.S.R. . |
| 1222877 | 6/1968 | United Kingdom . |
| 1411950 | 10/1972 | United Kingdom . |
| 1474018 | 3/1973 | United Kingdom . |
| 2070426A | 2/1981 | United Kingdom . |
| 2077859A | 4/1981 | United Kingdom . |

OTHER PUBLICATIONS

Medo Catalog, Medo USA, Inc. Front/Back Covers and pp. 21-22.

Operator's Manual for Isolette Infant Incubator Model No. C100-I +IE, 1983, Trade Brochures from Air--Shields Inc. 330 Jacksonville Rd., Hatboro, Pa. 19040.

"Beyond the Double Wall . . . ", Trade Brochures from Air-Shields Inc., 330 Jacksonville Rd., Hatboro, Pa. 19040.

"In the Isolette Infant Incubator Tradition . . . ", Trade Brochures from Air-Shields, Inc., 330 Jacksonville Rd., Hatboro, Pa. 19040.

"Baby Your Budget", Trade Brochures from Air--Shields, Inc., 330 Jacksonville Rd., Hatboro, Pa. 19040.

*Primary Examiner*—Lee S. Cohen
*Assistant Examiner*—John P. Lacyk
*Attorney, Agent, or Firm*—Ratner & Prestia

[57] ABSTRACT

An infant incubator mattress positioning assembly having a pair of pneumatic lift mechanisms spaced apart on the deck of the incubator. Each lift mechanism is individually controlled to selectively raise or lower the ends of a mattress support which rest on the lift mechanisms. To prevent twisting or turning of the mattress support about its long axis as external forces are applied to the mattress support, each lift mechanism has transverse stabilizing means.

15 Claims, 5 Drawing Sheets

FIG. 6A
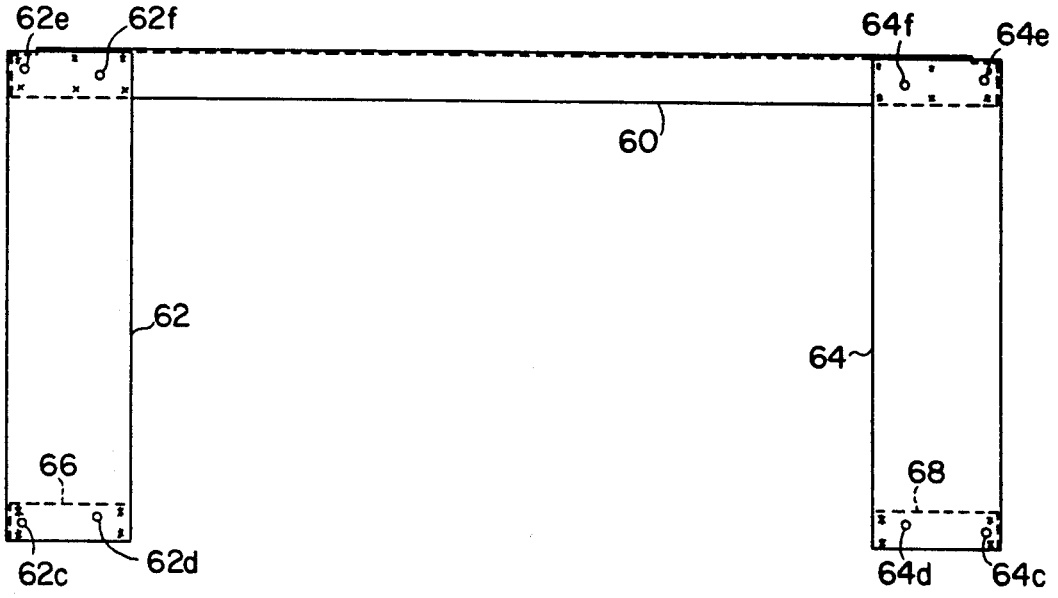
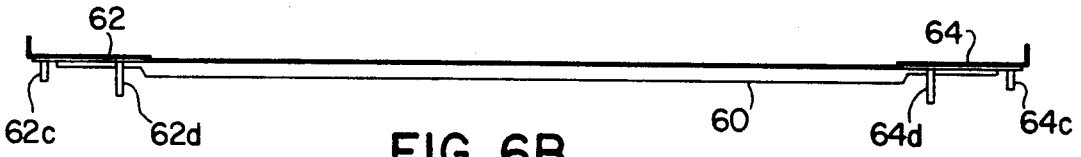
FIG. 6B
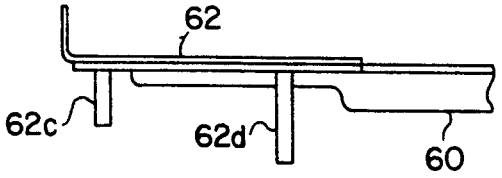
FIG. 6C

INFANT INCUBATOR MATTRESS POSITIONING ASSEMBLY

RELATED APPLICATION

This application is a continuation-in-part of application Ser. No. 07/656,420 filed Feb. 15, 1991 and entitled INFANT INCUBATOR MATTRESS POSITIONING ASSEMBLY now abandoned.

TECHNICAL FIELD

The present invention relates, in general, to lift mechanisms and, in particular, to apparatus for lifting and tilting an infant incubator mattress.

BACKGROUND OF THE INVENTION

Infant incubators are arranged so that the mattress upon which the infant lies can be tilted for certain medical procedures and conditions and lifted to permit placement of an X-ray cassette under the mattress tray without disturbing the baby. In some incubators, mattress tilt or lift is accomplished by simple lever mechanisms with positive stops at one or two positions. Such lever mechanisms are difficult to operate in a smooth manner because of the positive stops When the mattress nears the positive stop position, it can undergo a sudden, rapid, small displacement as the stopping mechanism locks in place. This movement can startle an infant on the mattress. Another disadvantage of such lever mechanisms is that the mattress can be positioned only at the preset stops.

Other infant incubators have somewhat complex mechanisms to provide a continuously variable mattress tilt or lift. Typically, these mechanisms employ long lead screws. Among the drawbacks of these mechanisms is that they are difficult to clean which must be done on a regular basis because they are located inside the incubator environment. The difficulty in cleaning comes about because of the extended length of the threaded profile of the lead screw and it is usually in an area that is difficult to access.

Another shortcoming of some lead screw mechanisms currently in use is that the mechanical advantage varies from one end of the stroke to the other end, whereby there is a large rise of the mattress for each crank revolution at one end of the stroke and a small rise for each crank revolution at the other end of the stroke. This results in a high torque requirement on the input crank at one end of the stroke or an inordinate number of turns required on the crank at the other end of the stroke or both.

Other shortcomings of incubator mattress lift arrangements in use at the present time which employ lead screw mechanisms are high cost and complicated linkage design.

U.S. Pat. No. 3,335,713 to Grosholz et al. discloses an infant incubator in which the inclination of the mattress support tray is controlled by a pneumatic cell. The arrangement disclosed in this patent, however, provides inadequate longitudinal and transverse stability to the mattress support tray when forces are applied to the mattress support tray when, for example, the infant on the mattress is being treated or equipment is placed on the mattress.

DISCLOSURE OF THE INVENTION

A preferred embodiment of an infant incubator mattress positioning assembly, constructed in accordance with the present invention, includes a support structure and a mattress support First and second pneumatic expansion means are mounted on the support structure and each has an end movable relative to the support structure and with which an end of the mattress support moves, so that when fluid is selectively applied to either or both of the pneumatic expansion means, the respective end or ends of the mattress support move away from the support structure and when fluid is selectively released from either or both of the pneumatic expansion means, the respective end or ends of the mattress support move toward the support structure. Associated with each of the pneumatic expansion means are transverse stabilizing means which extend between the support structure and the respective movable ends of the pneumatic expansion means. The transverse stabilizing means oppose forces applied to the mattress support which are directed toward the support structure and tend to move the mattress support about an axis extending along the length of the mattress support.

With two lift mechanisms included in the preferred embodiment of the present invention, two directions of tilt of the mattress support are provided. In another preferred embodiment of the present invention, only one tilt mechanism is provided with the other end of the mattress support resting on the support structure, so that only one direction of tilt is provided. If the reverse tilt condition is desired, the infant is simply turned around.

BRIEF DESCRIPTION OF THE DRAWINGS

FIGS. 6A and 6B are plan and front views, respectively, of the substructure of a second embodiment of a mattress support for a mattress positioning assembly constructed in accordance with the present invention.

FIG. 6C is a front view, on an enlarged scale, of a portion of the mattress support substructure of FIGS. 6A and 6B.

BEST MODE OF CARRYING OUT THE INVENTION

Figure 2:
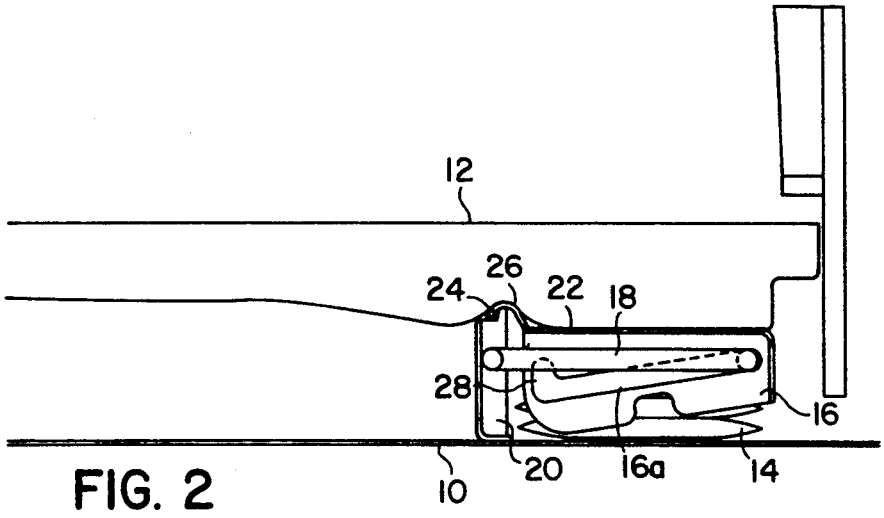
FIG. 2 is a side view of one end of a first embodiment of a mattress positioning assembly, constructed in accordance with the present invention, in its collapsed position.
Figure 3:
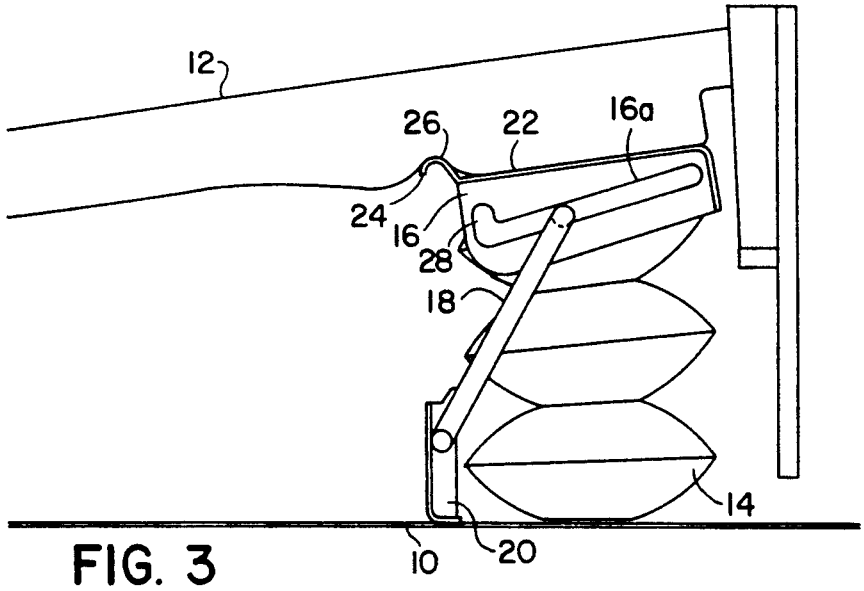
FIG. 3 is a side view, generally similar to FIG. 2, of the mattress positioning assembly of FIG. 2 in a raised position.
Figure 4:
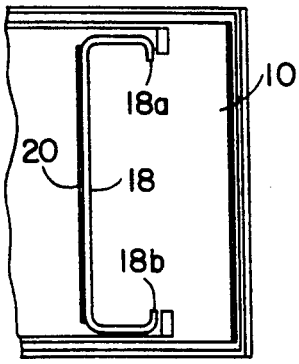
FIG. 4 is a plan view of a portion of the transverse stabilizing mechanism of the mattress positioning assembly of FIGS. 2 and 3.
Figure 7A:
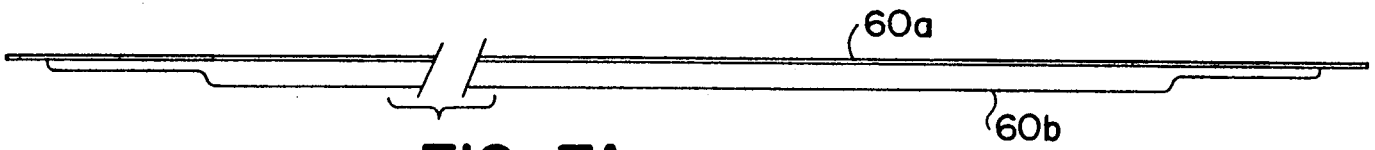
FIGS. 7A and 7B are front and side views, respectively, of the support stiffener of the mattress support substructure of FIGS. 6A, 6B and 6C.
Figure 7B:
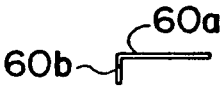

Referring to FIGS. 1 through 4 of the drawings, an infant incubator mattress positioning assembly, constructed in accordance with the present invention, includes a support structure 10, namely the deck of an infant incubator, and a mattress support 12 of solid rectangular configuration. Also included in this infant incubator mattress positioning assembly are first and second pneumatic expansion means which are spaced apart on support structure 10 for moving the opposite ends of mattress support 12 toward and away from the support structure. FIGS. 2 and 3 show the details of one of the pneumatic expansion means on an enlarged scale. In the preferred embodiment of the present invention which is described and illustrated, the first and second pneumatic expansion means are identical and mirror images of each other, so that a description of the details of one of the pneumatic expansion means is applicable to the other.

In the preferred embodiments of the present invention, each pneumatic expansion means includes an inflatable bellows 14 which is mounted on support structure 10. The other end of bellows 14 is movable relative to support structure 10 when the bellows is inflated with fluid or fluid is released from the bellows.

Each of the opposite ends of mattress support 12 rests on the upper end of one of the bellows 14 by way of a block 16. Each block 16 is part of a transverse stabilizing means, one such means associated with each of the bellows, which extend between support structure 10 and the movable end of the bellows for opposing forces applied to mattress support 12 which are directed downward toward support structure 10 and tend to move the mattress support about an axis extending along the length of the mattress support. Such forces are imparted to mattress support 12, for example, by the position of the infant itself, or by a physician attending to the infant, or by the weight of auxiliary monitoring or therapeutic equipment positioned on the mattress support.

For the embodiment of the invention which is described and illustrated, the transverse stabilizing means can include, in addition to block 16, an elongated torsion bar 18 pivotally mounted on support structure 10 by means of a block 20 secured to the support structure and within which the torsion bar is free to rotate, as shown by the different positions of the torsion bar in FIGS. 2 and 3. As shown most clearly in FIG. 4, torsion bar 18 has bent ends 18*a* and 18*b*. These ends of torsion bar 18 slidingly engage openings 16*a* at the opposite ends of block 16. This is most clearly shown in FIGS. 2 and 3.

As bellows 14 is inflated with fluid and block 16 moves from the position illustrated in FIG. 2 to the position illustrated in FIG. 3, torsion bar 18 pivots from the position illustrated in FIG. 2 to the position illustrated in FIG. 3 and the ends of the torsion bar slide in their respective openings at opposite ends in block 16 from the position illustrated in FIG. 2 to the position illustrated in FIG. 3. At any pivotal position of torsion bar 18, the rigidity of the torsion bar resists the tendency of mattress support 12 to twist as might otherwise occur, for example, by the application of a load to a corner of the mattress support.

Secured to block 16 is a plate 22 with a hooked end 24 which fits within a notch 26 in mattress support 12. The engagement of hooked end 24 of plate 22 and notch 26 in mattress support 12 serves two purposes. First, it prevents sliding of mattress support 12 relative to block 16 along the longitudinal axis of the mattress support when one end of the mattress support is higher than the other. Second, it guides transverse movement of mattress support 12 when the mattress support is moved toward the front of the incubator to bring the infant closer to one attending to the infant.

Openings 16*a* at the ends of block 16 preferably have an upturned length 28 at that end of the opening which is reached by torsion bar 18 at maximum inflation of the bellows. In the event of a failure in the pneumatic system, the mattress support can be elevated manually and locked in place by engagement of torsion bar 18 in the upturned length 28 of opening 16*a*.

Figure 1:
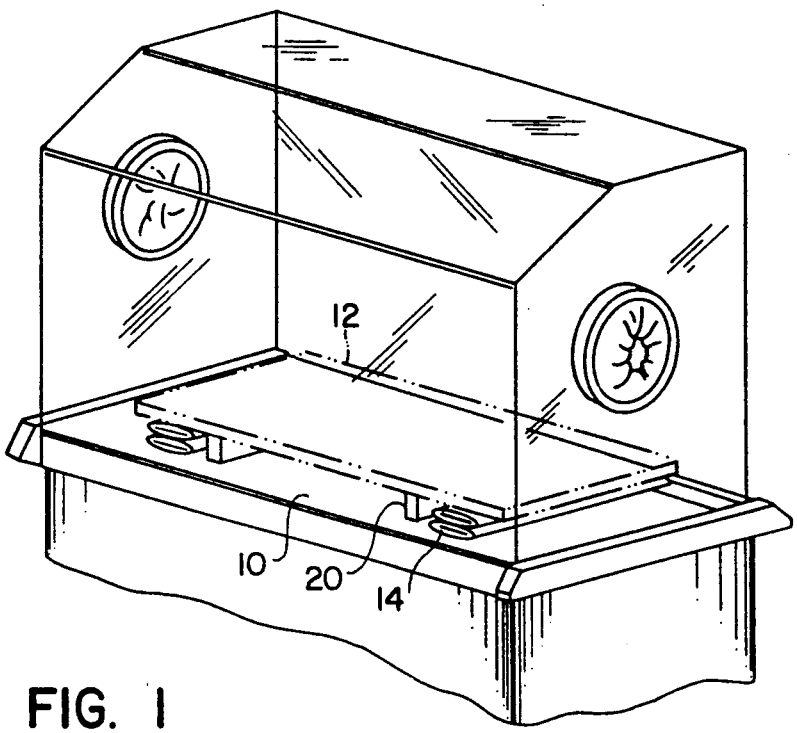
FIG. 1 is a perspective view of an infant incubator with a mattress positioning assembly, constructed in accordance with the present invention, in its collapsed position.
Figure 5:
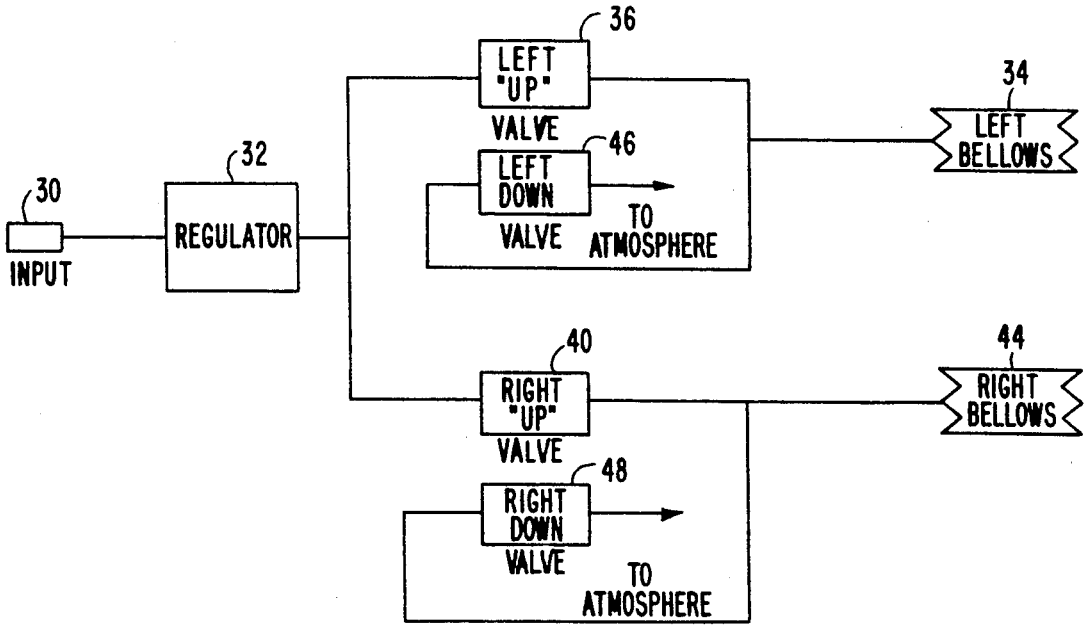
FIG. 5 is a schematic block diagram of a control system for a mattress positioning assembly constructed in accordance with the present invention.

Referring to FIG. 5, which is a schematic block diagram of a control system for an infant incubator mattress positioning assembly constructed in accordance with the present invention, input fluid is introduced from an air source 30 and passes through a regulator 32. The regulated input fluid is selectively supplied to a left bellows 34 through a left "up" valve 36 to inflate this bellows. Similarly, a right "up" valve 40 passes regulated input fluid to the right bellows 44 to inflate this bellows. The selective inflation of the respective bellows, preferably accomplished by actuation of the "up" valves conveniently located on the incubator housing, causes either or both ends of the mattress support to move upward individually to a desired height or heights.

The ends of the mattress support are selectively moved downward individually by actuation of a left "down" valve 46 or a right "down" valve 48. When either of these valves is opened, fluid in the associated bellows is released to the atmosphere. The selective deflation of the bellows is preferably accomplished by actuation of the "down" valves conveniently located on the incubator housing.

Figure 8A:
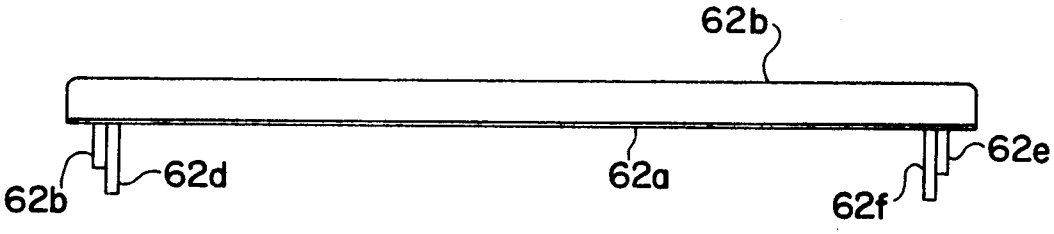
FIGS. 8A and 8B are side and front views, respectively, of the support plate of the mattress support substructure of FIGS. 6A, 6B and 6C.
Figure 8B:
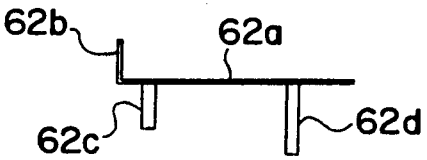

FIGS. 6A, 6B, 6C, 7A, 7B, 8A and 8B are various views of the substructure of a second preferred embodiment of a mattress support and its components which can be incorporated in the present invention. Referring to these figures, the components of this mattress support are a support stiffener 60, first and second support plates 62 and 64, and first and second spacer plates 66 and 68. As shown most clearly in FIGS. 7A and 7B, support stiffener 60 has a horizontal flange 60*a* and a downwardly extending vertical flange 60*b*. As shown most clearly in FIGS. 8A and 8B, each of the support plates 62 and 64 has a horizontal flange, an upwardly extending vertical flange and two pairs of pins at opposite ends of the support plate. FIGS. 8A and 8B only show support plate 62 and its horizontal flange 62*a*, its upwardly extending vertical flange 62*b* and its pin pairs 62*c*, 62*d* and 62*e*, 62*f*. Support plate 64 is arranged as a mirror image of support plate 62. Pin pairs 64*c*, 64*d* and 64*e*, 64*f* of support plate 64 are shown in FIGS. 6A and 6B.

When assembled, the mattress support substructure of FIGS. 6A, 6B and 6C is U-shaped. This is shown in FIG. 6A and is in contrast to the embodiment of the invention shown in FIGS. 1, 2 and 3 in which the mattress support includes a solid rectangular piece, the opposite ends of which rest on the two transverse stabilizing means. The mattress support substructure shown in FIGS. 6A, 6B and 6C is assembled by passing pins 62*e* and 62*f* of support plate 62 through aligned openings at one end of the horizontal flange 60*a* of support stiffener 60 and pins 64*e* and 64*f* of support plate 64 through aligned openings at the opposite end of the horizontal flange 60*a* of support stiffener 60. In addition, pins 62*c* and 62*d* of support plate 62 are passed through aligned openings in spacer plate 66 and pins 64*c* and 64*d* of support plate 64 are passed through aligned openings in spacer plate 68.

Figure 9:
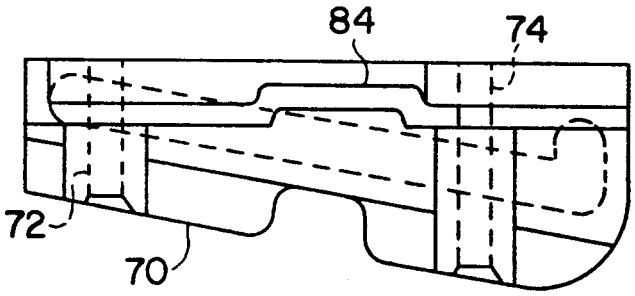
FIG. 9 is a rear view of a modified transverse stabilizing mechanism block of a mattress positioning assembly constructed in accordance with the present invention.

Referring to FIG. 9, a block 70, serving the same purpose as block 16 of FIGS. 2 and 3, has a pair of bores 72 and 74 arranged to receive a pair of pins of one of the support plates 62 or 64. Four such blocks, located at the ends of the legs of the U-shaped mattress support substructure and at the corners of the base of the U-shaped mattress support substructure, are provided as parts of a transverse stabilizing means which is arranged to function in the same manner as the transverse stabilizing means of the FIGS. 2, 3 and 4 embodiment of the present invention.

Figure 10:
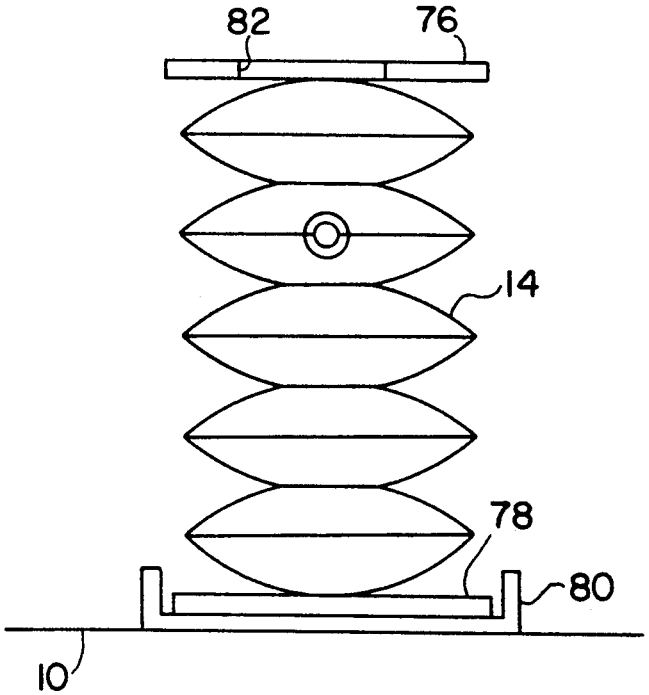
FIG. 10 is a front view of a second embodiment of an inflatable bellows assembly of a mattress positioning assembly constructed in accordance with the present invention.

As shown in FIG. 10, the inflatable bellows assembly can include a pair of rectangular plates 76 and 78 which are attached by suitable means to the opposite ends of inflatable bellows 14. The lower plate 78 is positioned for limited movement in a channel 80 mounted on support structure 10 and running transverse to the incubator. The upper plate 76 has two notches at its opposite ends (only one of which is shown in FIG. 10 and is identified by reference numeral 82) which are shaped and located to receive a raised boss 84 of block 70 of FIG. 9, whereby the upper end of inflatable bellows 14 is secured to block 70. In this way, the side legs of the U-shaped mattress support substructure (i.e. support plates 62 and 64), which lie over and are secured to the two transverse stabilizing means, are attached to the two bellows assemblies and the base of the U-shaped mattress support substructure extends between the two transverse stabilizing means attaching them together. A mattress support, similar to the one shown in FIG. 1, then can be placed over the mattress support substructure.

The foregoing has set forth exemplary and preferred embodiments of the present invention. It will be understood, however, that various alternatives will occur to those of ordinary skill in the art without departure from the spirit and scope of the present invention.

What is claimed:

1. An infant incubator mattress positioning assembly comprising:

a support structure;

a mattress support having first and second ends and rigid throughout its length;

first pneumatic expansion means mounted on said support structure and having an end movable perpendicularly relative to said support structure and with which said first end of said mattress support moves for moving said first end of said mattress support toward and away from said support structure;

first transverse stabilizing means extending between said support structure and said movable end of said first pneumatic expansion means for opposing forces applied to said mattress support directed toward said support structure and tending to move said mattress support about an axis extending along the length of said mattress support;

second pneumatic expansion means mounted on said support structure and having an end movable perpendicularly relative to said support structure and with which said second end of said mattress support moves for moving said second end of said mattress support toward and away from said support structure;

second transverse stabilizing means extending between said support structure and said movable end of said second pneumatic expansion means for opposing forces applied to said mattress support directed toward said support structure and tending to move said mattress support about an axis extending along the length of said mattress support;

and means for selectively supplying fluid to said first pneumatic expansion means and said second pneumatic expansion means to move said first end of said mattress support and said second end of said mattress support, respectively, away from said support structure and for selectively releasing fluid from first pneumatic expansion means and said second pneumatic expansion means to move said first end of said mattress support and said second end of said mattress support, respectively, toward said support structure.

2. An infant incubator mattress positioning assembly according to claim 1 wherein each of said pneumatic expansion means includes an inflatable bellows.

3. An infant incubator mattress positioning assembly according to claim 2 wherein said mattress support is a solid rectangle and said first and said second ends of said mattress support are opposite ends of said solid rectangle which rest atop said first and said second transverse stabilizing means.

4. An infant incubator mattress positioning assembly according to claim 3 wherein each of said transverse stabilizing means include:

(a) a block resting on said movable end of the respective pneumatic expansion means, and (b) an elongated torsion bar pivotally mounted on said support structure and having ends slidingly engaging opposite ends of the respective block.

5. An infant incubator mattress positioning assembly according to claim 3 said solid rectangle mattress support rests directly atop said first and second transverse stabilizing means.

6. An infant incubator mattress positioning assembly according to claim 4 wherein:

(a) each of said transverse stabilizing means includes a plate attached to one of said blocks and having a hooked end, and (b) said solid rectangle mattress support has a plurality of notches on the underside thereof engaged by said hooked ends of said plates to prevent relative movement between said mattress support and said blocks along a longitudinal axis of said mattress support and to permit guided movement of said mattress support relative to said blocks in a direction transverse to said mattress support.

7. An infant incubator mattress positioning assembly according to claim 2 further including a U-shaped mattress support substructure having a pair of side legs connected by a base between said mattress support and said first and said second transverse stabilizing means and having each side leg of the "U" lying over and secured to one of said transverse stabilizing means and said base of said "U" extending between said first and said second transverse stabilizing means.

8. An infant incubator mattress positioning assembly according to claim 7 wherein each of said transverse stabilizing means include:

(a) a pair of blocks to which said movable end of the respective pneumatic expansion means is secured, and (b) an elongated torsion bar pivotally mounted on said support structure and having ends slidingly engaging the respective blocks.

9. An infant incubator mattress positioning assembly according to claim 1 wherein each of said transverse stabilizing means include:

(a) a block resting on said movable end of the respective pneumatic expansion means, and (b) an elongated torsion bar pivotally mounted on said support structure and having ends slidingly engaging opposite ends of the respective block.

10. An infant incubator mattress positioning assembly according to claim 9 wherein each of said blocks has opposite ends and openings in said opposite ends which are slidingly engaged by said ends of said torsion bars.

11. An infant incubator mattress positioning assembly according to claim 10 wherein said openings in said blocks have ends and those ends of said openings, which are reached by said torsion bars when the respective pneumatic expansion means have been inflated to their maximum, have a length into which said torsion bars move to lock said torsion bars relative to said blocks.

12. An infant incubator mattress positioning assembly according to claim 1 wherein each of said transverse stabilizing means include:

(a) a pair of blocks to which said movable end of the respective pneumatic expansion means is secured, and (b) an elongated torsion bar pivotally mounted on said support structure and having ends slidingly engaging the respective blocks.

13. An infant incubator mattress positioning assembly according to claim 12 wherein each of said blocks has an opening in an end thereof which is slidingly engaged by an end of one of said torsion bars.

14. An infant incubator mattress positioning assembly according to claim 13 wherein said openings in said blocks have ends and those ends of said openings, which are reached by said torsion bars when the respective pneumatic expansion means have been inflated to their maximum, have a length into which said torsion bars move to lock said torsion bars relative to said blocks.

15. An infant incubator mattress positioning assembly according to claim 1 further including means extending between said first and said second transverse stabilizing means for attaching said first and said second transverse stabilizing means together.

* * * * *

UNITED STATES PATENT AND TRADEMARK OFFICE

CERTIFICATE OF CORRECTION

PATENT NO. : 5,244,452

DATED : September 14, 1993

INVENTOR(S) : Robert K. Vaccaro et al

It is certified that error appears in the above-indentified patent and that said Letters Patent is hereby corrected as shown below:

Column 6, line 44 (claim 5), insert --said-- between "and" and "second".

Signed and Sealed this

Nineteenth Day of July, 1994

Bruce Lehman

*Attest:*

BRUCE LEHMAN

*Attesting Officer*

*Commissioner of Patents and Trademarks*